US007537555B2

(12) United States Patent
Soletski

(10) Patent No.: US 7,537,555 B2
(45) Date of Patent: May 26, 2009

(54) ONE-PIECE, LIGHTWEIGHT EXTREMITY EXERCISE DEVICE

(76) Inventor: Michael M. Soletski, 955 Coggins Ct., Green Bay, WI (US) 54313

( * ) Notice: Subject to any disclaimer, the term of this patent is extended or adjusted under 35 U.S.C. 154(b) by 0 days.

(21) Appl. No.: 12/070,935

(22) Filed: Feb. 22, 2008

(65) Prior Publication Data

US 2008/0167166 A1 Jul. 10, 2008

Related U.S. Application Data

(63) Continuation-in-part of application No. 11/473,587, filed on Jun. 22, 2006, now abandoned.

(51) Int. Cl.
*A63B 26/00* (2006.01)

(52) U.S. Cl. ..... 482/142; 482/79; 482/146

(58) Field of Classification Search ..... 482/70, 482/79, 85, 90, 101, 115, 122, 132, 139, 482/145, 146, 147, 34, 80; 601/27–32; D21/668, D21/670, 688, 689, 690; 446/396; 273/449
See application file for complete search history.

(56) References Cited

U.S. PATENT DOCUMENTS

| | | | |
|---|---|---|---|
| 246,458 | A | 8/1881 | Chandler |
| 1,497,243 | A | 6/1924 | Martin |
| 1,911,572 | A | 5/1933 | Hulander |
| 2,253,996 | A | 8/1941 | Bechman |
| 2,374,730 | A | 5/1945 | DeForest |
| 2,714,007 | A | 7/1955 | Jordan |
| D178,996 | S | 10/1956 | Gordon |
| 2,830,816 | A | 4/1958 | Uhl |
| 2,941,801 | A | 6/1960 | Pedersen |
| 2,950,120 | A | 8/1960 | Stewart |
| D189,826 | S | 2/1961 | Katz |
| 3,107,914 | A | 10/1963 | Swisher |
| 3,188,087 | A | 6/1965 | Larson, Jr. |
| 3,201,120 | A | 8/1965 | Clifford |
| D202,796 | S | 11/1965 | Patterson |
| 3,262,701 | A | 7/1966 | Egbert |
| 3,279,794 | A | 10/1966 | Jenkins |
| 3,361,427 | A | 1/1968 | Paves |

(Continued)

FOREIGN PATENT DOCUMENTS

| | | |
|---|---|---|
| GB | 2233570 | 1/1991 |

*Primary Examiner*—Loan H Thanh
*Assistant Examiner*—Daniel F Roland
(74) *Attorney, Agent, or Firm*—Wilhelm Law Service; Thomas J. Connelly

(57) ABSTRACT

An exercise device is disclosed for facilitating blood circulation in the lower extremities of a person's legs and feet. The exercise device includes a one piece member having upper surface and a lower surface. The lower surface has an arcuate section designed to directly contact a floor. The arcuate section is located between first and second planar sections. Each of the first and second planar sections is inclined downward at an angle relative to the arcuate section. A pair of spaced apart ramps is formed in the upper surface and each extends downwardly from a back surface to a front surface. Each of the ramps is designed to receive a portion of a person's foot while an adjoining heel of each foot rest on the floor. The person can rock the exercise device back and forth by shifting his weight from one foot to the other.

17 Claims, 4 Drawing Sheets

U.S. PATENT DOCUMENTS 3,416,792 A 12/1968 Morgan et al.
3,485,493 A 12/1969 Pitkanen
3,612,520 A 10/1971 Chang
D227,584 S 7/1973 Perez
3,967,820 A 7/1976 Harper
D255,372 S 6/1980 Tidmore
D264,987 S 6/1982 Wise
D276,062 S 10/1984 Dennis
4,501,421 A 2/1985 Kane et al.
4,705,272 A 11/1987 Rupprecht
4,759,542 A 7/1988 Hudec
4,801,140 A * 1/1989 Bergeron ..... 482/146
4,817,950 A 4/1989 Goo
D315,584 S 3/1991 Gappa et al.
D319,084 S 8/1991 Bush
5,190,506 A 3/1993 Zubik et al.
5,232,419 A 8/1993 Kozak
5,330,399 A 7/1994 Fan
5,496,248 A 3/1996 Batscher
5,643,164 A 7/1997 Teff
5,730,690 A 3/1998 Guidry
D405,845 S 2/1999 Blythe
5,897,474 A 4/1999 Romero
5,984,841 A 11/1999 John
D418,563 S 1/2000 Hwang
D420,407 S 2/2000 Garcia et al.
6,203,473 B1 3/2001 Atwood
6,447,429 B1 9/2002 Chen et al.
6,461,285 B1 10/2002 Theunissen et al.
6,543,769 B1 4/2003 Podoloff et al.
D499,456 S 12/2004 Hsu
6,830,539 B2 12/2004 Chuang
6,945,920 B1 9/2005 Kemery et al.
7,137,938 B2 11/2006 Gottlieb
2001/0016544 A1 8/2001 McKechnie et al.
2002/0142894 A1 10/2002 Flynn
2004/0259704 A1 12/2004 Liang
2005/0282684 A1 12/2005 Hakooz

* cited by examiner

ONE-PIECE, LIGHTWEIGHT EXTREMITY EXERCISE DEVICE

CROSS-REFERENCE TO RELATED APPLICATION

This patent application is a continuation-in-part patent application claiming priority to U.S. regular patent application U.S. Ser. No. 11/473,587 filed Jun. 22, 2006.

FIELD OF THE INVENTION

This invention relates to a one piece, lightweight exercise device for facilitating blood circulation in the lower extremities of a person's legs and feet.

BACKGROUND OF THE INVENTION

Today, many people sit for extended periods of time at a work station, as a passenger in an airplane or in a car, on a bus, on a train, etc. In the new computer age, many adults and children spend an enormous amount of time sitting in front of a desktop or a laptop computer taking care of business, surfing the web, playing video games, purchasing merchandise, etc. It is well known that prolonged sitting, such as at a desk, in front of a computer screen, seated at an airport terminal, or as a passenger in an airplane, car, bus or train results in poor blood circulation in the lower extremities, especially in the lower portion of the legs below the knees and in the feet. A known remedy for such poor circulation is to periodically exercise the lower extremities. Where the person has the option of periodically getting up and walking about, such walking can alleviate at least some of the poor circulation issues. However, many people work at jobs which require that they remain at their work stations for prolonged periods of time, negating the option of getting up and walking around to address such blood circulation issues.

For those who are unable to get up and walk around, it is desirable that they engage in some form of exercise while sitting.

Today, a variety of exercise devices exist which are primarily designed to be used in a large open area such as a gym. Many are large and are formed from metal, metal alloys, steel, stainless steel, cast iron, etc. so as to be sturdy and long lasting. Some of these exercise devices are designed to be stepped onto or to be stood on while performing a particular exercise. Such exercise devices are normally not moved from one location to another but are positioned such that the person who is working out rotates among the various pieces of exercise equipment. Each exercise device may be designed to work only certain muscles of a person's body. Very few exercise devices are manufactured as a one piece, lightweight portable device that can be easily carried by a person to and from work or by a person who is traveling as a passenger on an airplane, car, bus or train. Many exercise devices are not sized to be positioned under a desk or computer table, either in a home environment, at work or on public transportation.

A related problem of poor blood circulation in a person's legs or feet exists among people who have limited mobility for other reasons. Such reasons include but are not limited to: those who have a leg, ankle or foot injury, those with leg neuropathy or leg degradations, those who are too weak to walk, the aged, those afflicted with a disease or those recovering from certain medical procedures, such as a foot operation, and the like. In addition, some medically challenged people, such as the handicapped or wheelchair bound individuals, as well as those suffering from a temporary or a permanent infirmity may not be able to stand on their own. All of the above individuals would benefit from a one piece, lightweight exercise device that they could use to properly exercise their legs and/or feet to ensure proper levels of blood circulation.

Now, an exercise device for facilitating blood circulation in the lower extremities of a person's legs and feet has been invented. The one piece, lightweight exercise device is relatively small and portable, and is easily carried and moved. The exercise device can be placed on the floor under a person's desk, work station or computer table or it can be placed on the floor in front of a person seated in a chair or seat. The chair or seat can be at home, in a work environment, in an airport terminal, on an airplane, a car, a bus, a train, etc.

SUMMARY OF THE INVENTION

Briefly, this invention relates to a one piece, lightweight exercise device for facilitating blood circulation in the lower extremities of a person's legs and feet. The exercise device includes a one piece member having a longitudinal central axis and a transverse central axis. The member has an upper surface with a first side edge spaced apart from a second side edge. The member also has a lower surface having an arcuate section designed to directly contact a floor and having a midpoint located along the transverse central axis. The arcuate section is located between first and second planar sections. The first planar section has a distal end joined to the first side edge and the second planar section has a distal end joined to the second side edge. Each of the first and second planar sections extends at an angle to the longitudinal central axis and is inclined downward relative to the midpoint of the arcuate section. The one piece member further has a front surface and a back surface. A pair of spaced apart ramps is formed in the upper surface and are aligned perpendicular to the longitudinal central axis. Each ramp extends downwardly at an angle from the back surface to the front surface. Each of the ramps is designed to receive a portion of a person's foot while an adjoining heel of each foot rests on the floor. The person can rock the exercise device back and forth about its midpoint by shifting his or her weight from one foot to the other.

The general object of this invention is to provide a one piece, lightweight exercise device for facilitating blood circulation in the lower extremities of a person's legs and feet which is formed as a single, integral member and can be easily transported. A more specific object of this invention is to provide a one piece, lightweight exercise device which can be used when a person is seated in a chair or seat and has limited opportunity to stand up or walk around.

Another object of this invention is to provide a one piece, lightweight exercise device which is inexpensive to manufacture and economical to purchase.

A further object of this invention is to provide a one piece, exercise device that weights less than a pound and can help prevent a person suffering from a pulmonary embolism.

Still another object of this invention is to provide a one piece, lightweight exercise device for facilitating blood circulation in the lower extremities of a person's legs and feet which can be constructed of a non-metallic material.

Still further, an object of this invention is to provide a one piece, lightweight exercise device for facilitating blood circulation in the lower extremities of a person's legs and feet which can be used when a person is seated on an airplane or when riding as a passenger in a car, bus or train.

Other objects and advantages of the present invention will become more apparent to those skilled in the art in view of the following description and the accompanying drawings.

DETAILED DESCRIPTION OF THE INVENTION

Figure 1:
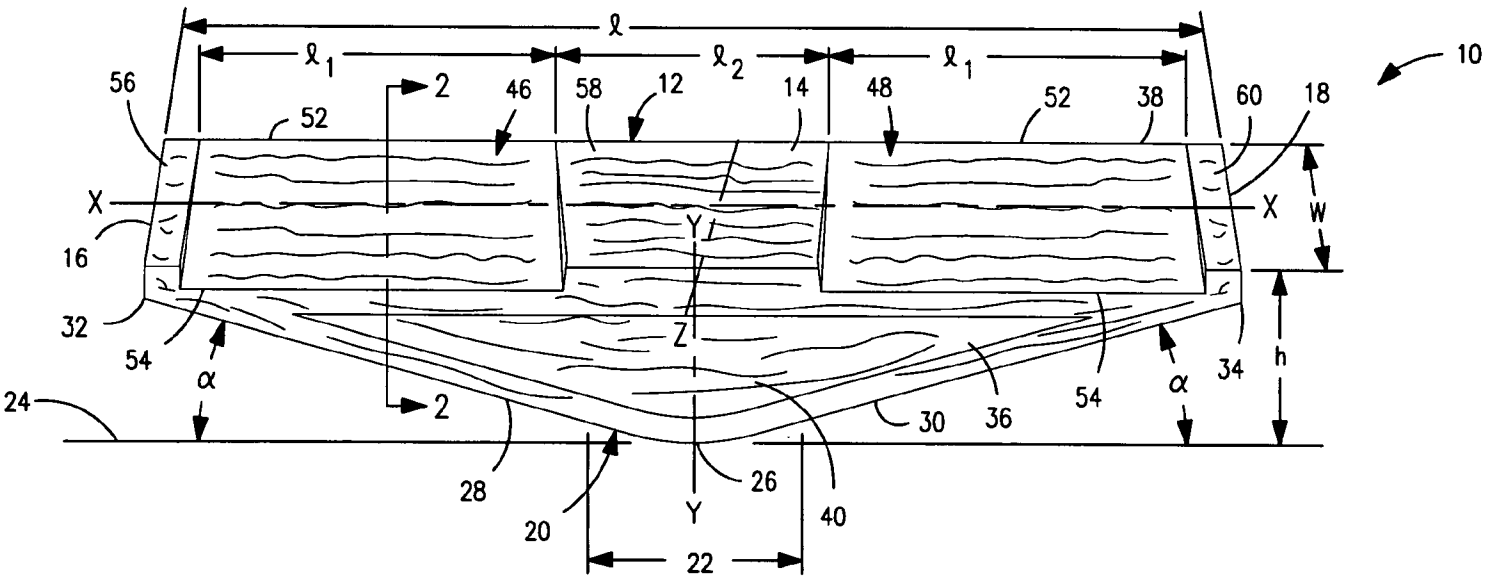
FIG. 1 is a pictorial view of a one piece, lightweight exercise device for facilitating blood circulation in the lower extremities of a person's legs and feet and illustrating a front surface and an upper surface.
Figure 2:
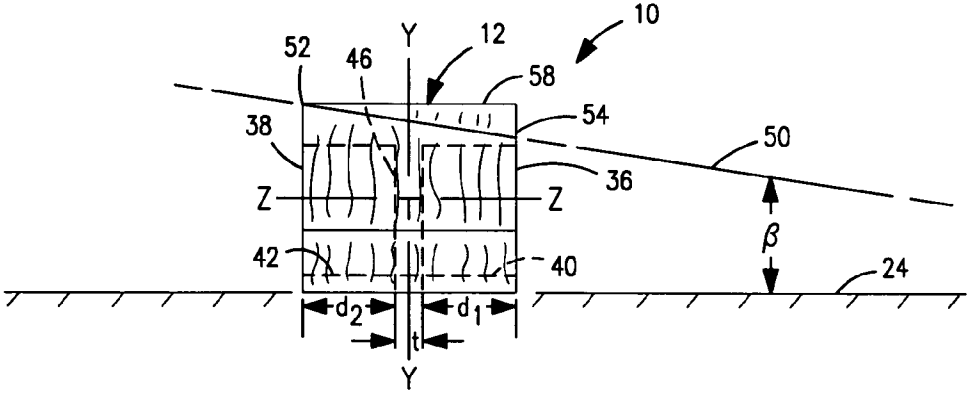
FIG. 2 is a cross-section of the one piece, lightweight exercise device taken along line 2-2 of FIG. 1.

Referring to FIGS. 1 and 2, an exercise device 10 is depicted which is particularly useful in enabling a person to exercise and/or massage their lower extremities. By "lower extremities" it is mean the muscles, tendons, etc. located below the knees. Such muscles, including the calf muscles, the muscles associated with the ankles and the muscles associated with the feet and toes do not get exercised by a person who is required to sit for extended periods of time. The exercise device 10 has been designed to allow one to work the calf muscles and the muscles in the feet and ankles by being able to rock the exercise device 10 up and down from the left side to the right side while the person using the exercise device 10 has his or her heels positioned on the floor or underlying surface. The exercise device 10 can stimulate blood circulation in the muscles, especially in the calf muscles, so as to prevent blood clots from forming. One reason blood clots tend to form in the calf region when a person who is seated for extended periods of time is that there is little or no movement of such muscles. Research studies have shown that when a person is immobilized for extended periods of time in a seated position, such as an office worker seated at a desk, a person traveling as a passenger on an airplane, bus, train, car, etc., or a person confined to a wheel chair, for example while living in a nursing home or some other type of convalescent facility, that limited mobility can cause blood clots to occur. For healthy people on the go, the exercise device 10 has been designed to provide them with an easy way to exercise the calf and foot muscles while confined to a seating position. The exercise device 10 is lightweight and portable such that it can be easily carried in a tote bag, duffle bag, back pack, brief case, attaché case, etc. The exercise device 10 can be used in an environment where other people are present or can be used when a person is all alone.

The exercise device 10 is formed as a one piece member 12. By a "one piece member" it is meant a single or unitary member having no secondary members, parts or fasteners connected or assembled thereto. The one piece member 12 has a longitudinal central axis X-X, a transverse central axis Y-Y, and a vertical central axis Z-Z. The one piece member 12 has an upper surface 14 with a first side edge 16 spaced apart from a second side edge 18. The one piece member 12 has a length l measured parallel to the longitudinal central axis X-X. The length l extends from the first side edge 16 to the second side edge 18. The length l of the one piece member 12 can range from between about 12 inches to about 24 inches. Desirably, the length l of the one piece member 12 is less than about 20 inches. More desirably, the length l of the one piece member 12 is less than about 18 inches. Even more desirably, the length l of the one piece member 12 is less than about 16 inches. Most desirably, the length l of the one piece member 12 is about 15 inches. By limiting the length l of the one piece member 12 to a dimension of from between about 12 to about 15 inches, one can create an exercise device 10 that is very easy to transport and that can fit into a tote bag, duffle bag, back pack, brief case, attaché case, etc.

The one piece member 12 also has a height h measured parallel to the transverse central axis Y-Y and a width w measured parallel to the vertical central axis Z-Z. The height h of the one piece member 12 can vary. The height h can range from between about 0.5 inches to about 6 inches. Desirably, the height h of the one piece member 12 ranges from between about 1 inch to about 4 inches. More desirably, the height h of the one piece member 12 is less than about 2.5 inches. Even more desirably, the height h of the one piece member 12 ranges from between about 1 inch to about 2 inches. Most desirably, the height h of the one piece member 12 is about 1.625 inches. By constructing the one piece member 12 to have a height h dimension of less than about 3 inches, one can create an exercise device 10 that is easy and comfortable for various individuals to use regardless of their particular height or weight. Furthermore, when the height h of the one piece member 12 is less than about 4 inches, it can comfortably be used by a person who is seated in a chair regardless of the distance the seat portion of the chair is located above an underlying surface, such as a floor.

The width w of the one piece member 12 can also vary. The width w can range from between about 0.5 inches to about 4 inches. Desirably, the width w of the one piece member 12 ranges from between about 1 inch to about 3 inches. More desirably, the width w of the one piece member 12 is less than about 2.5 inches. Even more desirably, the width w of the one piece member 12 is less than about 2 inches. Most desirably, the width w of the one piece member 12 is about 1.625 inches. By constructing the one piece member 12 to have a width w dimension of less than about 4 inches, one can create an exercise device 10 that is sufficient to receive the balls of a person feet and is comfortable for various individuals to use regardless of their particular foot size.

In one embodiment, the exercise device 10 can be constructed such that the height h of the one piece member 12 is equal to the width w of the one piece member 12.

The one piece member 12 also has a lower surface 20 having an arcuate section 22 designed to directly contact an underlying surface 24, for example a floor or the ground. The arcuate section 22 has a midpoint 26 located midway along the length l of the one piece member 12. The midpoint 26 is located on the transverse central axis Y-Y. The arcuate section 22 is structurally configured to form an effective rocking radius. The arcuate section 22 can be a circular arc. Desirably, the arcuate section 22 has a configuration that provides the least amount of resistance to the rocking motion contemplated for the exercise device 10. The effective rocking radius is at least about 0.13 inches. By "effective rocking radius" it is meant a surface of a stated dimension which enables the exercise device 10 to rock back and forth in an exercise action which simulates, or approximates, the action of a rocking motion. As illustrated, though not limiting, the effective rocking radius can range from between about 0.13 inches to about 2.25 inches. The effective rocking radius can have any of a wide range of sizes, so long as the rocking radius is large enough to provide a smooth transition from side to side, and so long as some stop structure is provided in association with the lower surface 20.

The arcuate section 22 can span an arcuate distance of from between about 0.5 inches to about 2.25 inches. Desirably, the arcuate section 22 will span an arcuate distance of at least about 1 inch. More desirably, the arcuate section 22 will span an arcuate distance of at least about 1.5 inches. Even more desirably, the arcuate section 22 will span an arcuate distance of at least about 2 inches.

The arcuate section 22 is located between a first planar section 28 and a second planar section 30. The first planar section 28 is located on the left side of the transverse central axis Y-Y and to the left of the arcuate section 22. The second planar section 30 is located on the opposite or right side of the transverse central axis Y-Y and to the right of the arcuate section 22. The first planar section 28 has a distal end 32 intersecting the first side edge 16 and the second planar section 30 has a distal end 34 intersecting the second side edge 18. Each of the first and second planar sections, 28 and 30 respectively, extends at an angle to the longitudinal central axis X-X and each is inclined downward at an angle alpha $\alpha$ relative to the midpoint 26 of the arcuate section 22. Expressed another way, the first planar section 28 is inclined and tapers downward and inward from the distal end 32 towards the midpoint 26 of the arcuate section 22. Likewise, the second planar section 30 is inclined and tapers downward and inward from the distal end 34 towards the midpoint 26 of the arcuate section 22. The first planar section 28 extends in an intersecting fashion relative to the second planar section 30. Each of the first and second planar sections, 28 and 30 respectively, merge into the arcuate section 22 to create a rocking radius. The first and second planar sections 28 and 30 generally function as stop surfaces, stopping the rocking motion of the exercise device 10 when each comes into interfacial contact with the underlying support surface 24, such as a floor or the ground.

It should be noted that the first and second planar sections, 28 and 30 respectively, can have other surface characteristics, if desired. For example, the first and second planar surfaces, 28 and 30 respectively, can be represented by structural framework rather than solid surfaces. Similarly, the upper surface 14, the lower surface 20 and the arcuate section 22 can be fabricated as other than solid surfaces.

Referring again to FIG. 1, the angle alpha $\alpha$ is measured between the underlying surface 24 and the first planar section 28 or between the underlying surface 24 and the second planar section 30. The angle alpha $\alpha$ can range from between about 5 degrees to about 30 degrees. Desirably, the angle alpha $\alpha$ can range from between about 5 degrees to about 25 degrees. More desirably, angle alpha $\alpha$ can range from between about 5 degrees to about 20 degrees. Even more desirably, angle alpha $\alpha$ can range from between about 5 degrees to about 15 degrees. Most desirably, the angle alpha $\alpha$ can range from between about 10 degrees to about 15 degrees.

The exercise device 10 is illustrated as being symmetrical about the vertical central axis Z-Z or about the midpoint 26. While such symmetry is desired, it is not required. The one piece member 12 has a right side and a left side, each located adjacent to the transverse central axis Y-Y. Desirably, the right side is a mirror image of the left side. Alternatively, the right and left sides do not have to be mirror images of one another, if so desired.

The exercise device 10 can be formed from a variety of materials. Desirably, the exercise device 10 is formed from a lightweight material so that it can be easily transported from one location to another. The exercise device 10 can be formed or constructed from a number of different materials including but not limited to: a thermoplastic material, a plastic, a polyolefin such as polypropylene, polyethylene or variations thereof, metal, or a metal alloy, a non-metallic material or a non-metallic alloy, aluminum, titanium, magnesium, tin, wood, particle board, etc. Desirably, the exercise device 10 is constructed from a moldable plastic or a thermoplastic because they are easy to mold, low in cost and lightweight. The exercise device 10 should weigh less than two pounds (32 ounces). Desirably, the exercise device 10 should weigh less than one pound (16 ounces). More desirably, the exercise device 10 should weigh less than 14 ounces. Even more desirably, the exercise device 10 should weigh less than 12 ounces.

Figure 3:
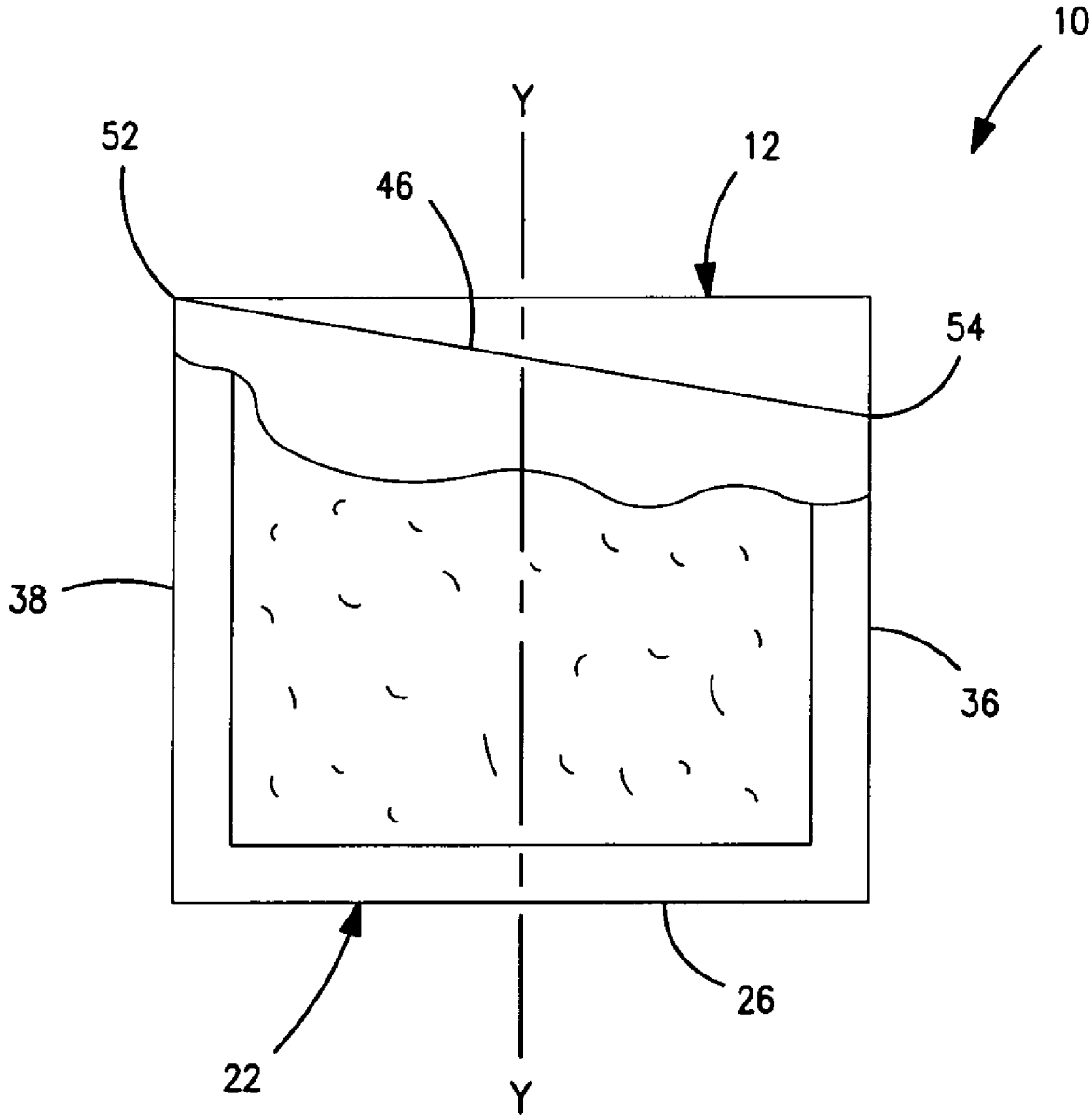
FIG. 3 is a cross-sectional view of an alternative embodiment of a one piece, lightweight exercise device partially cut away to reveal a core formed from a low-density material to minimize the weight of the exercise device.

Referring to FIG. 3, the exercise device 10 can also be formed from a composite material that includes two or more different materials. It is very important that the exercise device 10 be lightweight, be easy to manufacture, and be produced at a very reasonable cost. The lightweight feature is one of the unique features of the exercise device 10 since it is anticipated that the exercise device 10 will be readily transported from one location to another. For example, a person may use the exercise device 10 at home and then pack it in a tote bag or brief case and take it on an airplane where it can be easily retrieved and used while the person is seated as a passenger in an airplane seat. The exercise device 10 can be formed from a solid material. Alternatively, the exercise device 10 can be formed with one or more hollow cavities. For example, in the interest of controlling cost, where continuous surfaces are contemplated to enclose the exercise device 10, the central portion of the exercise device 10 can be a hollow cavity. In still another embodiment, the interior or core of the exercise device 10 can be filled with a low-density material so as to reduce its overall weight. For example, a central portion of the exercise device 10 can be filled with a low-density material such as a rigid foam. An open or a closed cell foam material can be used. The low-density material can be any kind of foam, including but not limited to: polystyrene, polyurethane, or some other light-weight material. Desirably, the low-density material is relatively rigid.

Still further, the exercise device 10 can be made as a connecting series of stringers and braces, as in bridge and/or truss construction. The exercise device 10 can have the appearance of an I beam with a portion of the lower surface having an arcuate shape. The construction of the exercise device 10 should be designed to provide proper support and strength for its intended purpose. In such instances, the quantity of material used can be optimized. Similarly, such bridgework or truss structure can be readily molded by plastic molding machines, and assembled as needed.

Returning again to FIGS. 1 and 2, the one piece member 12 has a front surface 36 and an oppositely aligned back surface 38, see FIG. 2. Each of the front and back surfaces 36 and 38 is positioned between the upper surface 14 and the lower surface 20. Each of the front and back surfaces, 36 and 38 respectively, has a predetermined surface area and a hollow area, 40 and 42 respectively, extending inwardly from each of the front and back surfaces, 36 and 38 respectively. Each of the hollow areas, 40 and 42 respectively, represents at least 30% of the predetermined surface area of each of the front and back surfaces, 36 and 38 respectively. Desirably, each of the hollow areas, 40 and 42 respectively, represents at least 50% of the predetermined surface area of each of the front and back surfaces, 36 and 38 respectively. More desirably, each of the hollow areas, 40 and 42 respectively, represents at least 70% of the predetermined surface area of each of the front and back surfaces, 36 and 38 respectively. Even more desirably, each of the hollow areas, 40 and 42 respectively, represents at least 80% of the predetermined surface area of each of the front and back surfaces, 36 and 38 respectively. Most desirably, each of the hollow areas, 40 and 42 respectively, represents at least 90% of the predetermined surface area of each of the front and back surfaces, 36 and 38 respectively. Each of the hollow areas, 40 and 42 respectively, extends inward from the front and back surfaces 36 and 38 respectively, such that each is clearly visible to a person using the exercise device 10. In other words, the hollow areas 40 and 42 are not closed or blocked off by any other member.

As best depicted in FIG. 2, the hollow area 40 has a depth $d_1$ and the hollow area 42 has a depth $d_2$. Each of the depths $d_1$ and $d_2$ is measured parallel to the vertical central axis Z-Z. The depth $d_1$ can be less than, equal to, or be greater than the depth $d_2$. Desirably, the depth $d_1$ is essentially equal to the depth $d_2$. Each of the depths $d_1$ and $d_2$ has a minimum dimension of at least about 0.25 inches. Desirably, each of the depths $d_1$ and $d_2$ has a minimum dimension of at least about 0.4 inches. More desirably, each of the depths $d_1$ and $d_2$ has a minimum dimension of at least about 0.5 inches. The two hollow areas 40 and 42 are separated by a rib 44, see FIG. 2. The rib 44 has a thickness t measured perpendicular to the vertical central axis Z-Z. The thickness t of the rib 44 can vary in dimension. The thickness t of the rib 44 should be at least about 0.125 inches. Desirably, the thickness of the rib 44 should be at least about 0.3 inches. More desirably, the thickness t of the rib 44 should be at least about 0.4 inches. Stated another way, the thickness t of the rib 44 should be equal to at least 20% of the width w of the one piece member 12. Desirably, the thickness t of the rib 44 should be equal to at least 22% of the width w of the one piece member 12. More desirably, the thickness t of the rib 44 should be equal to at least 25% of the width w of the one piece member 12. By forming the hollow areas 40 and 42 in the one piece member 12, one can substantially reduce the weight of the exercise device 10.

As stated above, the exercise device 10 is formed as a one piece member 12 that is lightweight so that it can be easily transported. Desirably, the one piece member 12 has a weight of from between 0.5 pounds to about 1 pound. More desirably, the one piece member 12 has a weight of from between about 10 ounces to about 16 ounces. Even more desirably, the one piece member 12 has a weight of less than about 14 ounces. Most desirably, the one piece member 12 has a weight of less than about 12 ounces.

Referring now to FIGS. 1-4, the exercise device 10 also includes a pair of spaced apart ramps 46 and 48 formed in the upper surface 14 of the one piece member 12. Each of the pair of ramps 46 and 48 is aligned perpendicular to the longitudinal central axis X-X. Each of the pair of ramps 46 and 48 has an upper end 52 and a lower end 54. Each of the pair of ramps 46 and 48 extends downward at an angle beta β, see FIG. 2, from the back surface 38 to the front surface 36. Desirably, the incline is continuous from the back surface 38 to the front surface 36. The angle beta β can range from between about 5 degrees to about 15 degrees when measured from the underlying support surface 24, i.e. the floor or the ground. Desirably, the angle beta β can range from between about 5 degrees to about 10 degrees when measured from the underlying support surface 24. More desirably, the angle beta β can range from between about 6 degrees to about 9 degrees when measured from the underlying support surface 24. Even more desirably, the angle beta β can range from between about 7 degrees to about 8 degrees when measured from the underlying support surface 24. The angle beta β can range from between about 7 degrees to about 8 degrees especially when the width w of the one piece member 12 is less than about 1.5 inches.

An important feature of the ramps 46 and 48 is that they are aligned in a suitable spatial relationship to one another and they function to enable the rocking motion of the exercise device 10. This rocking motion occurs when the person utilizing the exercise device 10 is seated adjacent to or is in a sitting position relative to the exercise device 10.

Referring again to FIG. 2, each of the ramps 46 and 48 extend in a common direction, typically within a common imaginary plane 50. Accordingly, the bottom surfaces of the feet of a person using the exercise device 10 are typically in the common imaginary plane 50.

Referring again to FIGS. 1 and 2, each of the ramps 46 and 48 extends over the entire width w of the one piece member 12. Each of the ramps 46 and 48 starts at the upper end 52 and is inclined downward at a constant angle to the lower end 54. Each of the ramps 46 and 48 has a length $l_1$, measured parallel to the longitudinal central axis X-X, of from between about 3 inches to about 6 inches. Desirably, each of the ramps 46 and 48 has a length $l_1$ of from between about 4 inches to about 5 inches. More desirably, each of the ramps 46 and 48 has a length $l_1$ of from between about 4.5 inches to about 5 inches. Even more desirably, each of the ramps 46 and 48 has a length $l_1$ of about 4.75 inches.

Each of the ramps 46 and 48 is designed to receive a portion of a person's foot while the adjoining heel of each respective foot rest on the underlying support surface 24, i.e. the floor. Each of the ramps 46 and 48 is sized and designed to receive a portion of the ball of each foot. By "ball" it is meant that portion of the lower surface of a human foot located between the toes and the arch. The ball portion of each foot is situated at varying distances from the adjoining heel depending upon the foot size in a particular individual. In an adult, the ball is usually situated from between about 3 to about 6 inches forward of the center of the heel. The downward angle β permits each foot to be comfortably positioned such that the distal end of each heel will rest on the underlying support surface 24, i.e. the floor, and the ball of each foot will be centered on one of the pair of ramps 46 and 48. The exercise device 10 can be moved laterally outward away from the person using the exercise device 10. This distance will vary depending upon the elevation of the seat the person is sitting in, the length of their legs, the size of their feet, etc. With the person seated in a chair, in an airplane seat, on a stool, etc., the person can depress his or her right foot downward while simultaneously removing downward pressure exerted by his or her left foot. This action will cause the first planar section 28 to move upward and the second planar section 30 to move downward, in a rocking fashion, towards the underlying support surface 24. The person would then depress his or her left foot downward while simultaneously removing downward pressure exerted by his or her right foot. This action will cause the exercise device 10 to rock back such that the first planar section 28 will approach the underlying support surface 24 and the second planar section 30 will move upward away from the underlying support surface 24. At this time, the exercise device 10 will rock back and forth about the midpoint 26 of the arcuate section 22 and parallel to the longitudinal central axis X-X. As the person alternates the pressure applied onto each of the ramps 46 and 48, he or she can increase the blood flow to each of his or her feet and leg muscles, especially to the calf muscles. This action increases blood circulation in the lower extremities of the body, especially that area located below the knees. The increased blood flow will decrease the chance of the person having or developing a blood clot that could move to his or her lung and cause a pulmonary embolism or some other medical condition.

Referring again to FIG. 1, the ramp 46, located left of the midpoint 26, is sandwiched between an outside shoulder 56 and a central abutment 58. The outside shoulder 56 and the central abutment 58 are formed in the upper surface 14 of the one piece member 12. The outside shoulder 56 and the central abutment 58 cooperate to ensure that the left foot of the person using the exercise device 10 will not slide off of the ramp 46. The outside shoulder 56 and the central abutment 58 should be at least 0.05 inches in height, and desirably, at least 0.1 inches in height. Likewise, the ramp 48, located right of the midpoint 26, is sandwiched between an outside shoulder 60 and a central abutment 58. The outside shoulder 60 is also formed in the upper surface 14 of the one piece member 12. The outside shoulder 60 and the central abutment 58 cooperate to ensure that the right foot of the person using the exercise device 10 will not slide off of the ramp 48. The outside shoulder 60 should also be at least 0.05 inches in height, and desirably, at least 0.1 inches in height. Due to the incline of each of the ramps 46 and 48, the shoulders 56 and 60, as well as the central abutment 58, will have their greatest height adjacent to the lower end 54. This is important because each foot is aligned at an angle to each of the ramps 46 and 48 and the outside shoulders 56 and 60 will provide a positive stop to prevent each respective foot from moving laterally outward at this location.

As best depicted in FIG. 1, the central abutment 58 can vary in size and configuration. Desirably, the central abutment 58 extends from the front surface 36 to the back surface 38. The central abutment 58 has a length $l_2$, measured parallel to the longitudinal central axis X-X. The length $l_2$ of the central abutment 58 can vary in dimension. Desirably, the length $l_2$ of the central abutment 58 ranges from between about 1 inch to about 6 inches in dimension. More desirably, the length $l_2$ of the central abutment 58 is less than 4 inches in dimension. Even more desirably, the length $l_2$ of the central abutment 58 is less than 3 inches in dimension. Most desirably, the length $l_2$ of the central abutment 58 is about 2 inches in dimension.

Figure 4:
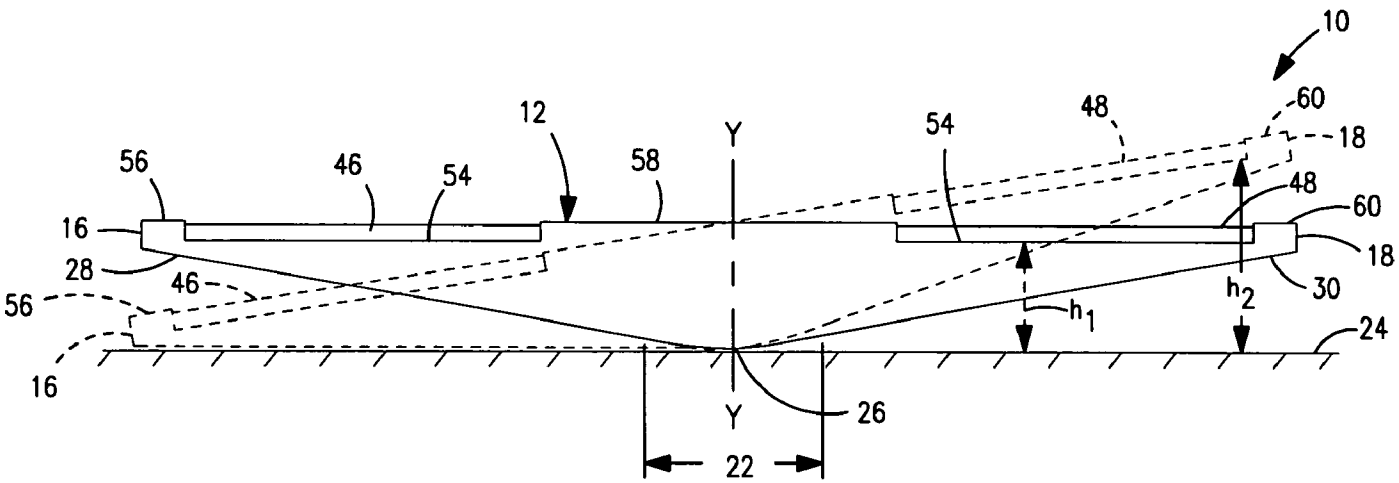
FIG. 4 is a front elevation view of the one piece, lightweight exercise device shown in FIG. 1.

Referring to FIG. 4, when the exercise device 10 is in a generally horizontal position, as illustrated, the lower ends 54, 54 of both of the ramps 46 and 48 are located at the same height $h_1$ above the underlying support surface 24, i.e. the floor. This is the normal orientation of the exercise device 10 before one places their feet on the ramps 46 and 48, since the exercise device 10 is balanced and stable. The height $h_1$ of the ramps 46 and 48 in this initial position facilitates the use of the exercise device 10. Assuming that the person who is ready to use the exercise device 10 is sitting, his or her heels will be positioned on the underlying support surface 24, i.e. the floor, adjacent to the ramps 46 and 48. If the height $h_1$ is too low, the exercise device 10 may be ineffective in providing the desired level of exercise. If the height $h_1$ is too high, the balls of the user's feet will not reach to the lower ends 54, 54 of the ramps 46 and 48 while the heels are on the underlying support surface 24. In the alternative, the user can position the toes of his or her feet on the ramps 46 and 48, if the height $h_1$ is too excessive. However, this is not the optimal use of the exercise device 10.

Figure 5:
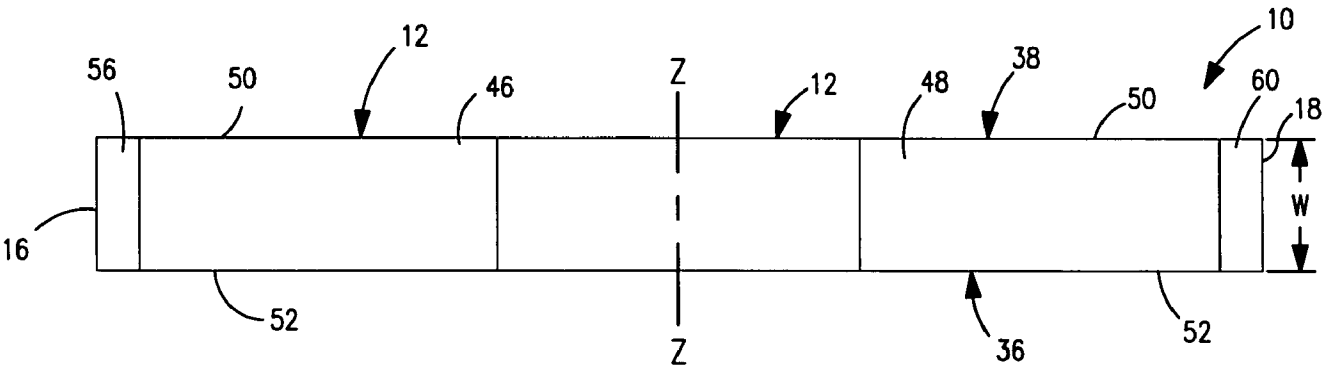
FIG. 5 is a top view of the one piece, lightweight exercise device shown in FIG. 1.

Referring to FIGS. 4 and 5, another factor which affects the height $h_1$ at the lower ends 54, 54 of the ramps 46 and 48 is the width w of the exercise device 10 when measured at the first and second side edges, 16 and 18 respectively. The wider the width w of the exercise device 10, the less the vertical travel distance between the upper surface 14 of the underlying support surface 24. This is illustrated at the right side of FIG. 4 in dashed outline. The bottom of the rocking action is illustrated at the left side of FIG. 4 in dashed outline. Specifically, the height $h_2$ is the vertical difference between the lower ends 54, 54 of the ramp 48 and the underlying support surface 24. Namely, the relationship between the lower end 54 of the ramps 46 or 48, and the adjacent underlying support surface 24, establishes the extremities of the vertical distance between the bottom of the rocking motion and the top of the rocking motion.

At the bottom of the rocking motion, the ball of the person's foot can approach the floor level 24. At the top of the rocking motion, the ball of the person's foot can be as high off the floor as the ball can go with the heel still on the floor, and without overstressing the available range of motion of the person's foot about the user's ankle. In this regard, the maximum height $h_2$ of each of the lower ends 54, 54 of the ramps 46 and 48, at the top of the rocking motion, is about 6 inches. This is illustrated on the right side of FIG. 4.

With the upper limit of the rocking motion established at about 6 inches to the lower end 54 of each of the ramps 46 and 48, the range of motion between the upper limit and the lower limit is further established by the position of lower surface 20 relative to the lower ends 54, 54 of each of the ramps 46 and 48. In FIG. 4, the lower end 54 of each of the ramps 46 and 48 is about 0.1 inches to about 0.2 inches below the upper end 52 of each of the ramps 46 and 48. With the location of lower surface 20 thus established relative to the ramps 46 and 48, the vertical range of the rocking motion can thus be determined.

Still referring to FIG. 4, the lower end 54, 54 of each of the ramps 46 and 48 is typically between 0.25 inches and 0.5 inches off the floor 24 at the lower limit of the rocking motion. Minor increments downward can be achieved if desired. At the upper limit of the rocking motion, the lower end 54 of the raised ramp 48, as shown in dashed outline on the right side of FIG. 4, is between about 2.5 inches and about 6 inches off the underlying support surface 24. FIG. 4 illustrates the fact that the distance from the underlying support surface 24, i.e. the floor, to the ramps 46 and 48 varies from the distal end of the respective ramps 46 and 48 to the proximal end of the same ramp 46 or 48. Thus, the recited distances are approximations only, within the limits of the rocking motion of the exercise device 10.

A comfortable range of motion, as measured at the lower ends 54, 54 of each of the ramps 46 and 48 at the midpoint 26 of the one piece member 12, is about 0.25 inches off the underlying support surface 24 at the lower limit of the range of motion, and about 2.5 inches off the underlying support surface 24 at the upper limit of the range of motion. Thus, an illustrative range of rocking motion, without limitation, is about 0.5 inches to about 4 inches, from the bottom of the motion of the first side edge 16 to the top of the range of motion of that same end.

While a user's perception varies depending on what specific part of the foot is on the ramps 46 and 48, as the ramps 46 and 46 alternately approach the underlying support surface 24, i.e. the floor, the ball of the user's foot approaches the underlying support surface 24, whereby the user can perceive that his or her foot has reached the underlying support surface 24. Thus, the user may perceive a lower limit of the rocking motion as being a situation where his or her foot is approximately in contact with the underlying support surface 24, i.e. the floor.

Referring to FIGS. 4 and 5, the exercise device 10 is symmetrical about the transverse central axis Y-Y and the vertical central axis Z-Z. Expressed another way, the left and right sides of the exercise device 10 are symmetrical relative to the midpoint 26. The left and right sides of the exercise device 10 are mirror images of each other.

Figure 6:
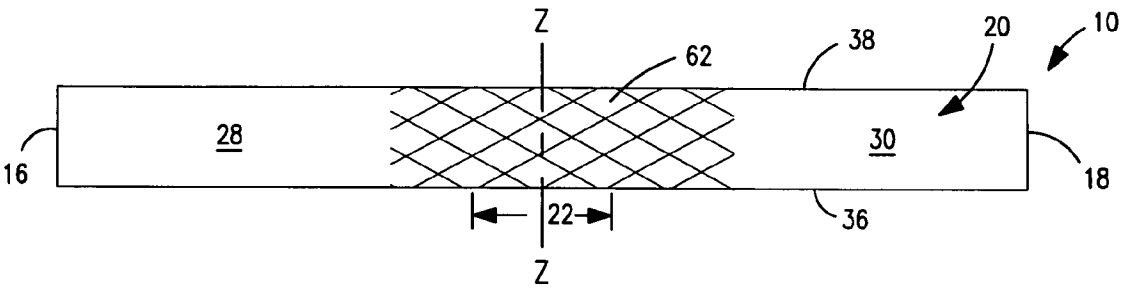
FIG. 6 is a bottom view of the one piece, lightweight exercise device shown in FIG. 1.

Referring now to FIG. 6, the lower surface 20 of the exercise device 10 can be treated, coated, machined, scored, constructed or altered to have a non-slip surface. The non-slip surface 62 can be a frictional surface, an abrasive surface, a harsh surface, a roughened surface, a contoured surface, etc. By "non-slip surface" it is meant a surface that resists the relative motion or tendency to easily move relative to a second surface which it comes in direct contact with. The non-slip surface 62 can be formed over the entire lower surface 20 of the exercise device 10. Alternatively, the non-slip surface 62 can be formed over a portion of the lower surface 20 of the exercise device 10. Desirably, the non-slip surface covers at least 25% of the lower surface 20. More desirably, the non-slip surface covers at least 30% of the lower surface 20. Even more desirably, the non-slip surface covers at least 35% of the lower surface 20. For example, the non-slip surface 62 can be formed or applied to the arcuate section 22 or to a larger area that encompasses the effective rocking radius and an adjacent portion of the lower surface 20. The non-slip surface 62 can be an abrasive surface, a roughened surface, a painted surface, a coated surface, a treated surface, etc. Examples of ways to form the non-slip surface 62 include but are not limited to: applying a coating which contains a multiplicity of small particles or granules such as sand, grit, stone, etc., applying a frictional coating to at least a portion of the lower surface 20, cutting or cross-grooving at least a portion of the lower surface 20, knurling at least a portion of the lower surface 20, forming ridges in at least a portion of the lower surface 20, machining apertures, grooves, slots, etc. in at least a portion of the lower surface 20, applying a thick rubberized coating or paint to at least a portion of the lower surface 20, treating that least a portion of the lower surface 20 with a chemical to etch a roughened surface using an acid, etc. These and other ways to form the non-slip surface will be known to those skilled in the art. Desirably, at least a portion of the arcuate section 22 contains a frictional coating or is treated or machined to exhibit a non-slip surface.

The non-slip surface 62 functions to prevent or limit the exercise device 10 from moving, sliding or walking on an underlying support surface 24, i.e. the floor. By "walking" it is meant a small left to right motion that allows the exercise device 10 to move away from its initial position. The non-slip surface 62 can also limit or prevent movement on a smooth floor, a textured floor, on carpeting, on a rug, on vinyl, on ceramic tile, on brick, on stone, on concrete, on asphalt, etc.

USE

Figure 7:
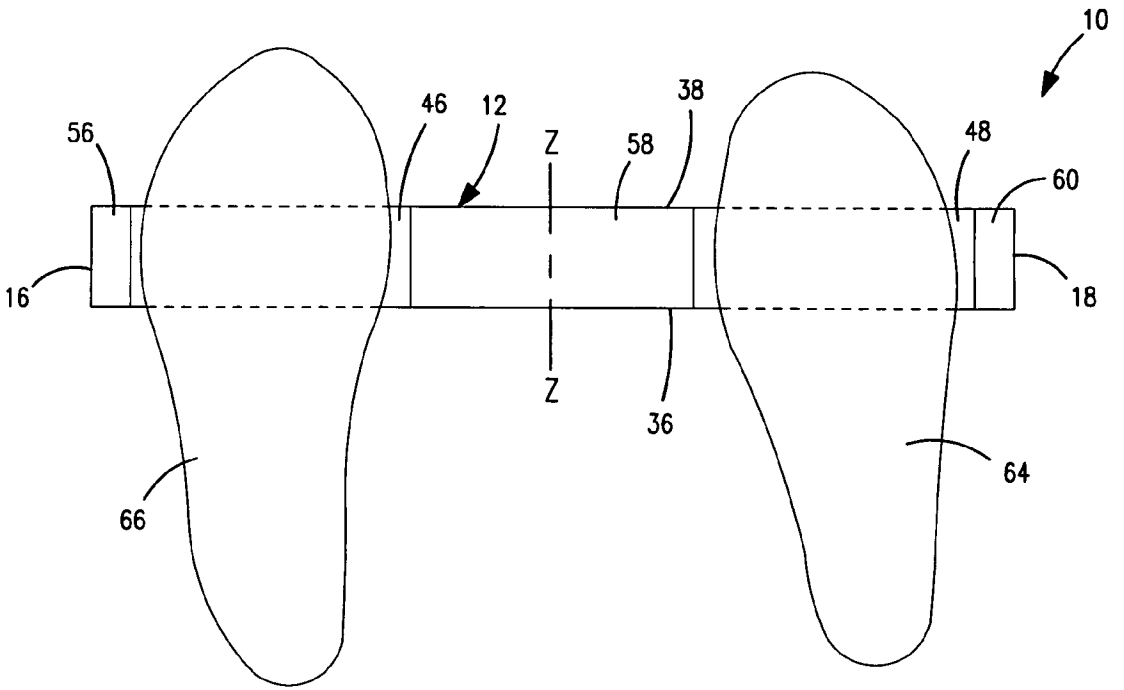
FIG. 7 is a top view of the one piece, lightweight exercise device shown in FIG. 5 with a pair of feet superimposed on the exercise device.

Referring to FIG. 7, the use of the exercise device 10 will now be explained. In FIG. 7, a right foot 64 and a left foot 66 are depicted. The exercise device 10 can be utilized by a male or a female. The exercise device 10 can be used by a child, a teenager or an adult. The exercise device 10 can be used by a healthy person, by a person confined to a wheelchair or by a person who is frail and/or elderly. The exercise device 10 can be used while the person is wearing shoes, sneakers, scandals, boots, etc., when the person is only wearing socks, or when the person has bare feet. Desirably, the person will be wearing shoes or sneakers. The exercise device 10 is designed to be used while a person is seated adjacent to it. The height of the chair, stool, couch or other seating apparatus does not matter. The seat can be a passenger seat in an airplane, a passenger seat in a car, on a train, on a bus, etc. The seat can be a common chair, a sofa, a couch, a stool, etc.

As explained above, the angle β defines the inclination of each of the ramps 46 and 48 relative to the underlying support surface 24. When the exercise device 10 is placed on the underlying support surface 24, i.e. the floor, the same angle β also defines the angle between each of the ramps 46 and 48 and the underlying support surface 24. With the exercise device 10 placed on the underlying support surface 24 and with the ramps 46 and 48 at a common height, the angle β of each of the ramps 46 and 48, generally represent an angle where the user can comfortably maintain his or her feet 64 and 66 on the ramps, 46 and 48 respectively, for an extended period of time. This condition assumes that no undue stress and/or discomfort are experienced by the user. In this orientation, the user's feet 64 and 66 can readily be aligned with the angle β of each of the ramps 46 and 48. With the user's heels on the underlying support surface 24, i.e. the floor, the bottoms of the user's feet 64 and 66, optionally wearing generally flat-soled shoes, define angles approximating the same angles β. This means that the user's feet 64 and 66 are generally aligned with the surfaces of the ramps 46 and 48. In this position, the person's feet 64 and 66 are aligned essentially parallel to one another.

As discussed above, while the exercise device 10 interfaces with the user's feet 64 and 66, the actual exercise activity provides substantial exercise to the legs, calf muscles and to the feet.

The user places the exercise device 10 on the underlying support surface 24, i.e. the floor, in front of a chair, stool or seat, and within easy reach of the user's feet 64 and 66 when the user is in the sitting position. The exercise device 10 is oriented with the front surface 36 facing the chair such that the longitudinal central axis X-X of the exercise device 10 is aligned parallel to the person's torso. In this orientation, the lower ends 54, 54 of the ramps 46 and 48 are closer to the chair than are the upper ends 52, 52 of the ramps 46 and 48.

The user sits in the chair or seat and places the heels of his or her feet 64 and 66 between the chair or seat and the exercise device 10. A good portion of the balls of the user's feet 64 and 66 reside on the ramps 46 and 48. Sometimes the toes can rest on the ramps 46 and 48 depending on the size of the user's feet 64 and 66 and the placement of their feet 64 and 66 on the exercise device 10. The user then places the balls of both feet 64 and 66 on the ramps 46 and 48 while maintaining his or her heels on the underlying support surface 24. Assuming the user's feet 64 and 66 apply equal weight on both of the ramps 46 and 48, the equal weight maintains the ramps 46 and 48 at approximately equal heights. The user then places a relatively greater weight on one ramp, say 48, while placing a relatively lesser weight on the other ramp 46.

As a result of the weight imbalance, the ramp which receives the greater weight moves downwardly while the ramp, which receives the lesser weight, moves upwardly. This starts the rocking motion which typically characterizes use of the exercise device 10. For example, the left ramp 46 moves down while the right ramp 48 moves up, as illustrated in dashed outline in FIG. 4.

The relative weight imbalance can be achieved by adding a greater level of downward force to the ramp which is to move downwardly such as by applying more weight, or by releasing some of the downward force on the other ramp, such as by applying a lifting force to that foot. For example, by applying a rotationally-upward force about the ankle, one can lift the ball of his or her foot upwardly. In the alternative, the relative weight imbalance can be achieved by simply lifting the ball of the foot under the ramp which is to rise. Still further, the weight imbalance can be achieved by a combination of applying weight and/or force to the ramp which is to be moved downwardly while releasing weight from the ramp which is to rise.

The left ramp 46 reaches the bottom of its path of travel when the first planar section 28 reaches the underlying support surface 24, i.e. the floor, as depicted by the dashed outline in FIG. 4. The user then reverses the weight and/or force imbalance by applying relatively more force and/or weight on the right foot ramp 48 and relatively less force and/or weight on the left foot ramp 46, which results in a reverse direction motion, namely the rising of the left foot ramp 46 and the downward motion of the right foot ramp 48. When the second planar section 30 reaches the underlying support surface 24, i.e. the floor, the user again reverses the weight imbalance, which again moves the left side of the exercise device 10 downwardly while the right side moves upwardly. This process is repeated as desired, resulting in a rocking motion of the exercise device 10, and corresponding movements in the feet 64 and 66 of the user, with cooperative contraction and expansion of the muscles in the user's legs.

When a person uses the exercise device 10 in a sitting position, the user can raise his or her heels off the underlying support surface 24, placing relatively more weight on the balls and/or toes of the feet 64 and 66, thus on the ramps 46 and 48. In this position, the user then uses his or her leg muscles to raise and lower the legs, and thus the corresponding ramps 46 and 48, to effect the above-described rocking motion, but as an exercise primarily for building leg muscle as well as for lower extremity blood circulation.

While the exercise devices 10 has been described in the context of a person sitting in a chair, the exercise device 10 can also be used by a person who is standing in one location for a substantial period of time. For example, a person standing at a work bench can place the balls of his or her feet 64 and 66 on the exercise device 10 and rock the exercise device 10 back and forth at will in that one location thus to exercise the legs and feet.

While the invention has been described in conjunction with several specific embodiments, it is to be understood that many alternatives, modifications and variations will be apparent to those skilled in the art in light of the aforegoing description. Accordingly, this invention is intended to embrace all such alternatives, modifications and variations which fall within the spirit and scope of the appended claims.

I claim:

1. An exercise device for facilitating blood circulation in the lower extremities of a person's legs and feet, comprising: a) a one piece member having a longitudinal central axis and a transverse central axis, said member having an upper surface with a first side edge spaced apart from a second side edge, a lower surface having an arcuate section designed to directly contact an underlying support surface and having a midpoint located on said transverse central axis, said arcuate section is located between a first planar section and a second planar section, said first planar section having a distal end joined to said first side edge and said second planar section having a distal end joined to said second side edge, each of said first and second planar sections extending at an angle to said longitudinal central axis and inclined downward relative to said midpoint of said arcuate section, and a front surface and an oppositely aligned back surface each positioned between said upper and lower surfaces, wherein said front and back surfaces each has a predetermined surface area, and a hollow area is formed in each of said front and back surfaces which represent at least about 30% of said predetermined surface areas, and a rib is formed between said hollow areas that extends along said longitudinal central axis; b) a pair of spaced apart ramps formed in said upper surface and aligned perpendicular to said longitudinal central axis, each of said pair of ramps extending downwardly at an angle from said back surface to said front surface, and each of said pair of ramps designed to receive a portion of a ball of a person's foot while an adjoining heel of each foot rests on said underlying support surface, whereby said exercise device can be rocked back and forth about said midpoint of said arcuate section and parallel to said longitudinal central axis when said exercise device is placed on said underlying support surface and said person alternates pressure applied by said ball of each foot; and c) a central abutment formed in said upper surface and positioned along said transverse central axis, said central abutment ensuring that the person's feet do not slide off of said pair of spaced apart ramps.

2. The exercise device of claim 1 wherein said one piece member is formed from plastic and has a weight of less than 16 ounces, and said one piece member has a transverse central axis and a height measured parallel to said transverse central axis which is less than about 2.5 inches.

3. The exercise device of claim 1 wherein said hollow area represents at least about 70% of said predetermined surface areas.

4. The exercise device of claim 3 wherein said exercise device has a width w and said rib has a thickness equal to at least 20% of said width.

5. The exercise device of claim 1 wherein said one piece member is formed from a composite material having a weight of less than about 12 ounces.

6. The exercise device of claim 1 wherein said one piece member is formed of a non-metallic material and has a weight less than about 16 ounces.

7. The exercise device of claim 1 wherein said one piece member has a height measured along said transverse central axis and a width measured along said vertical central axis and said height is equal to said width.

8. The exercise device of claim 1 wherein each of said front and back surfaces has a predetermined surface area and a hollow area extends inwardly from each of said front and back surfaces, and each of said hollow areas represents at least 50% of said predetermined surface areas of each of said front and back surfaces.

9. An exercise device for facilitating blood circulation in the lower extremities of a person's legs and feet, comprising: a) a one piece member having a longitudinal central axis and a transverse central axis, said one piece member being constructed from a thermoplastic material and having an upper surface with a first side edge spaced apart from a second side edge, a lower surface having an arcuate section designed to directly contact a floor and having a midpoint located along said transverse central axis, said arcuate section is located between a first planar section and a second planar section, said first planar section having a distal end joined to said first side edge and said second planar section having a distal end joined to said second side edge, each of said first and second planar sections extending at an angle to said longitudinal central axis and inclined downward from between about 9 degrees to about 20 degrees relative to said midpoint of said arcuate section, a front surface and an oppositely aligned back surface each positioned between said upper and lower surfaces, and each of said front and back surfaces having a predetermined surface area and a hollow area extending inwardly from each of said front and back surfaces, each of said hollow areas representing at least 30% of said predetermined surface areas of each of said front and back surfaces, and a rib is formed between said hollow areas that extends along said longitudinal central axis; b) a pair of spaced apart ramps formed in said upper surface and aligned perpendicular to said longitudinal central axis, each ramp extending downwardly at an angle from said back surface to said front surface, and each of said pair of ramps designed to receive a portion of a ball of a person's foot while an adjoining heel of said foot rests on said floor, whereby said exercise device can be rocked back and forth about said midpoint of said arcuate section and parallel to said longitudinal central axis when said exercise device is placed on said floor and said person alternates pressure applied by said ball of each foot, and each of said first and second planar sections can directly contact said floor in an alternating fashion; and c) a central abutment formed in said upper surface and positioned along said transverse central axis, said central abutment ensuring that the person's feet do not slide off of said pair of spaced apart ramps.

10. The exercise device of claim 9 wherein said one piece member has a weight of less than about 16 ounces, and has a right side and a left side each located adjacent to said transverse central axis and said right side is a mirror image of said left side.

11. The exercise device of claim 10 wherein at least a portion of said lower surface of said one piece member contains a non-slip material.

12. The exercise device of claim 11 wherein at least a portion of said lower surface contains a frictional coating and said arcuate section has an effective rocking radius of at least about 0.13 inches.

13. The exercise device of claim 12 wherein at least a portion of said lower surface contains cross-grooving formed therein and each of said pair of spaced apart ramps is inclined at an angle of from between about 5 degrees to about 15 degrees.

14. The exercise device of claim 9 wherein said one piece member has a weight less than about 12 ounces, and has a transverse central axis and a height measured parallel to said transverse central axis which ranges from between about 1 inch to about 1.75 inches.

15. An exercise device for facilitating blood circulation in the lower extremities of a person's legs and feet, comprising: a) a one piece non-metallic member having a longitudinal central axis and a transverse central axis, said one piece member having an upper surface with a first side edge spaced apart from a second side edge, a lower surface having an arcuate section designed to directly contact a floor and having a midpoint located along said transverse central axis, said arcuate section is located between a first planar section and a second planar section and has an effective rocking radius of at least about 0.13 inches, said first planar section having a distal end joined to said first side edge and said second planar section having a distal end joined to said second side edge, each of said first and second planar sections extending at an angle to said longitudinal central axis and inclined downward from between about 10 degrees to about 20 degrees relative to said midpoint of said arcuate section, and a front surface and an oppositely aligned back surface each positioned between said upper and lower surfaces, wherein said front and back surfaces each has a predetermined surface area, and a hollow area is formed in each of said front and back surfaces which represent at least about 30% of said predetermined surface areas, and a rib is formed between said hollow areas that extends along said longitudinal central axis; b) a pair of spaced apart ramps formed in said upper surface and aligned perpendicular to said longitudinal central axis, each ramp extending downwardly at an angle of from between about 5 degrees to about 15 degrees from said back surface to said front surface, and each of said pair of ramps designed to receive a portion of a ball of a person's foot while an adjoining heel of said foot rests on said floor, whereby said one piece member can rock back and forth about said midpoint of said arcuate section and parallel to said longitudinal central axis when said exercise device is placed on said floor and said person alternates pressure applied by said ball of each foot, and each of said first and second planar sections can directly contact said floor in an alternating fashion; and c) a first outside shoulder formed in said upper surface adjacent to said first side edge and a second outsider shoulder formed in said upper surface adjacent to said second side edge, and a central abutment formed in said upper surface along said transverse central axis, said first and second outside shoulders cooperating with said central abutment to ensure that the person's feet do not slide off of said pair of spaced apart ramps.

16. The exercise device of claim 15 wherein when said one piece member is placed on a floor, each of said pair of spaced apart ramps has a lower end positioned at a common height relative to said floor, and each of said pair of spaced apart ramps are inclined at corresponding angles relative to said floor, such that a person sitting in a chair adjacent to said exercise device can place a heel of each foot on said floor and rest a ball of each foot on one of said pair of spaced apart ramps, with a bottom surface of each of said user's feet generally extending along extensions of said pair of spaced apart ramps and by shifting the weight from one foot to the other, cause said exercise device to rock back and forth and facilitate blood circulation in said lower extremities of said a person's legs and feet.

17. The exercise device of claim 15 wherein said entire arcuate section contains cross-grooving.

* * * * *